United States Patent [19]

Hogenson

[11] Patent Number: 4,708,057

[45] Date of Patent: Nov. 24, 1987

[54] PLATEN ASSEMBLY FOR SCREEN PRINTING

[75] Inventor: Tad C. Hogenson, West Jordan, Utah

[73] Assignee: T. Parker Distributing Company, Inc., Sandy, Utah

[21] Appl. No.: 855,252

[22] Filed: Apr. 23, 1986

[51] Int. Cl.[4] ..... B41M 1/12

[52] U.S. Cl. ..... 101/129; 101/127.1

[58] Field of Search ..... 101/114–115, 101/123, 127, 127.1, 129; 118/713, 715, 71, 301, 406, 503

[56] References Cited

U.S. PATENT DOCUMENTS

| | | | |
|---|---|---|---|
| 3,096,197 | 7/1963 | Buetow et al. | 101/129 X |
| 3,513,775 | 5/1970 | Guthrie | 101/129 |
| 3,926,112 | 12/1975 | Neman | 101/127.1 |
| 3,943,851 | 3/1976 | Inada et al. | 101/127.1 |
| 4,268,545 | 5/1981 | Hodulik | 101/129 |
| 4,315,461 | 2/1982 | Harpold | 101/115 |
| 4,381,706 | 5/1983 | Harpold | 101/127.1 |
| 4,440,080 | 4/1984 | Lyall | 101/129 |
| 4,463,673 | 8/1984 | Moore | 101/129 |
| 4,473,007 | 9/1984 | Colineau | 101/127.1 |
| 4,606,268 | 8/1986 | Jaffa | 101/115 |

FOREIGN PATENT DOCUMENTS

| | | | |
|---|---|---|---|
| 65557 | 5/1980 | Japan | 101/129 |
| 1564003 | 4/1980 | United Kingdom | 101/129 |

*Primary Examiner*—E. H. Eickholt

*Attorney, Agent, or Firm*—Robert R. Mallinckrodt; Philip A. Mallinckrodt

[57] ABSTRACT

A platen for use with a conventional screen printing machine for printing designs or patterns onto garments includes a window or windows formed in the body of the platen. The windows permit backlighting therethrough and through the garment material to enable the positioning and registration of a pattern on one side of a garment (the front side, for instance) to be registered with a pattern to be printed on the opposite side of the garment. The platen windows may be formed of a plexiglass material, either transparent or translucent, sufficient to permit light to pass therethrough. Light sources are positioned directly below the windows of the platen to enhance the backlighting effect for more accurate registration of patterns to be printed on the garment. A closed loop frame is adapted to fit around the periphery of the platen to hold a garment in position on the platen during the screen printing process. In this manner, registration is maintained for the patterns on multiple silk screens to enable multi-colored patterns to be silk screened onto both the front and the back of a garment.

22 Claims, 5 Drawing Figures

PLATEN ASSEMBLY FOR SCREEN PRINTING

BACKGROUND OF THE INVENTION

1. Field:

The invention is in the field of screen printing machines and in particular, of platen assemblies used in such machines for printing articles of clothing, such as tee shirts or the like.

2. State of the Art:

Screen printing of designs onto articles of clothing is a common practice. Most simply, an article of clothing, such as a tee shirt, is placed upon a flat surface, a silk screen is positioned on the tee shirt, and then ink is transfered through the screen onto the tee shirt by means of a roller or squeegee. When several colors are to be printed on the tee shirt, a number of silk screens are used, each silk screen being used with a different color. However, each subsequent silk screen must be aligned with the previously printed design for a satisfactory final product. Machines are now available to accommodate multiple screens and provide for registration and alignment of the individual designs on these multiple screens on a single tee shirt.

With presently used machines, the tee shirt to be printed is placed around a printing platen so that there is only a single layer of material between the platen and the silk screen. A thin layer of spray adhesive is applied to the platen immediately prior to placing the tee shirt thereon in order to hold the tee shirt essentially immovable on the platen during the screen printing processes. This not only holds the shirt against movement during actual printing which could cause smearing of the ink, but also, with multi-color printing, maintains the shirt in proper alignment and registration with respect to the different color silk screens so that the resulting multicolored design on the tee shirt will be in proper alignment with no color voids, overlaps, or blurrs.

A relatively recent concept in screen printed tee shirts is what is called in the trade a "wrap-around" design. This particular type of design wraps completely around the body portion of the shirt and appears to be a continuous design extending around the shirt. Complicated and expensive printing machines for printing these "wrap-around" designs onto tee shirts have been developed by one shirt manufacturer, but the cost of such machines prohibits their use in relatively low volume screen printing enterprises, such as custom printing shops. Such type of expensive wrap-around design printing apparatus involves placing the tee shirt about a cylindrical shaped platen, and then using a cylindrical shaped printing drum to print a continuous, wrap-around design onto the tee shirt.

Attempts have been made to print "wrap-around" designs onto tee shirts by using a flat printing platen or table. This process involves printing half of the wrap-around design onto one side of the tee shirt, either the front or the back, followed by printing the second half of the wrap-around design on the opposite side of the tee shirt. Although this may sound simple in theory, unless the alignment and registration of the front and back patterns are exact at both edges of the tee shirt where the designs meet (usually under the sleeves), misalignment occurs and the resulting pattern is not the intended "wrap-around" design but rather is a tee shirt having misaligned and disjointed front and back patterns.

The problem is compounded where multi-color wrap-around designs are attempted. This is because with a shirt merely placed on a flat surface, there is nothing to hold the top layer of material of the shirt and when the silk screen for the first color is raised from the garment, the garment tends to stick to the silk screen and be pulled up slightly when the silk screen is removed from the garment. As the shirt falls back to the platen, it may shift position slightly destroying any alignment or registration. Once the registration is lost, it is difficult to accurately realign or reregister the first color pattern on the shirt with subsequent colored patterns. Although it may be possible to closely reregister the garment on the printing platen to accept subsequent multi-color silk screens, such process is extremely time consuming and tedious, therefore greatly increasing production costs of a single multi-color, wrap-around design tee shirt.

SUMMARY OF THE INVENTION

According to the invention, an improved printing platen assembly for screen printing machines which allows easy alignment of an edge of an item where two printed designs are to meet includes a printing platen having transparent or translucent light transmitting sections located at least in the areas where the edges of the item needing alignment usually rests on the platen. In printing wrap-around designs on tee shirts or the like, the edges needing alignment are generally the sides of the tee shirt under each sleeve. Illumination means is preferably provided directly below the light transmitting sections such that light is directed through the light transmitting sections of the platen to the item thereon. In this manner, the operator can quickly and accurately align and register the first half of the pattern printed on one side of the item with the pattern to be printed on the opposite side of the item.

To assist in maintaining the tee shirt in substantially perfect alignment for printing this second pattern in registration with the first pattern, the platen assembly also includes an item retaining frame which is adapted to pivot downwardly toward the printing platen and essentially seal around the periphery of the printing platen in a manner to hold the tee shirt or other item in registration and alignment on the platen. The periphery of the platen may have a non-slip material such as naugahyde mounted thereon, preferably with a thin layer of sponge material positioned under the such non-slip material to bias such material against the item being held and the retaining frame to securely hold the item in position on the platen.

In practicing the method of the invention, the first design is printed on the item such as the first half of a wrap-around design printed on the front of a tee shirt. A portion of the design is printed on the light transmitting sections of the printing platen at least over the area where the edges of the item to be aligned will normally intersect the light transmitting section of the platen. Light is transmitted through the light transmitting section at the edge of the item to be aligned such that the outline or silhouette of the first design printed on the item may be quickly and accurately aligned with the pattern printed on the platen. The retaining frame is moved into retaining position to hold the item in its aligned position, any final alignment adjustments are made, and the second design is printed.

THE DRAWINGS

In the accompanying drawings, which illustrate the best mode presently contemplated for carrying out the invention:

Figure 2:
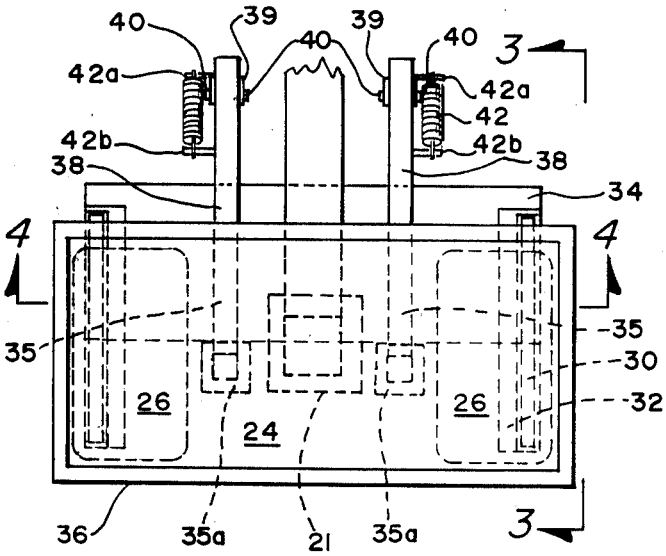
FIG. 2 is a top plan view of the printing platen assembly of the present invention showing the item retaining frame in functional position about the printing platen.
Figure 4:
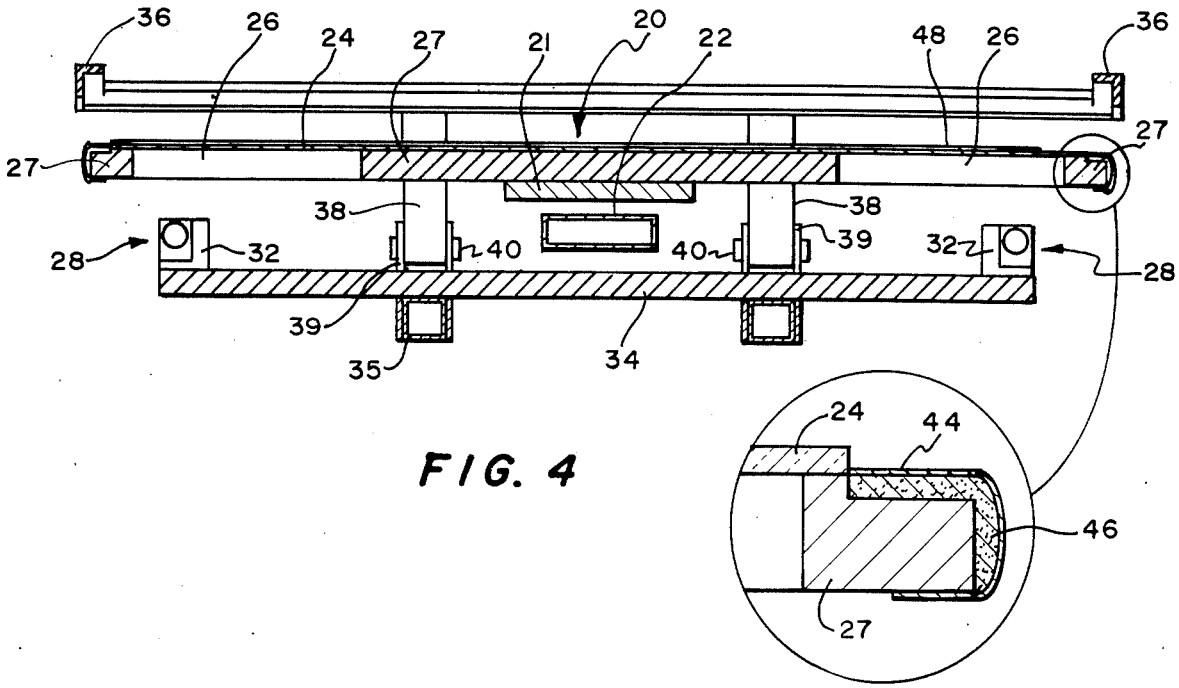
Figure 5:
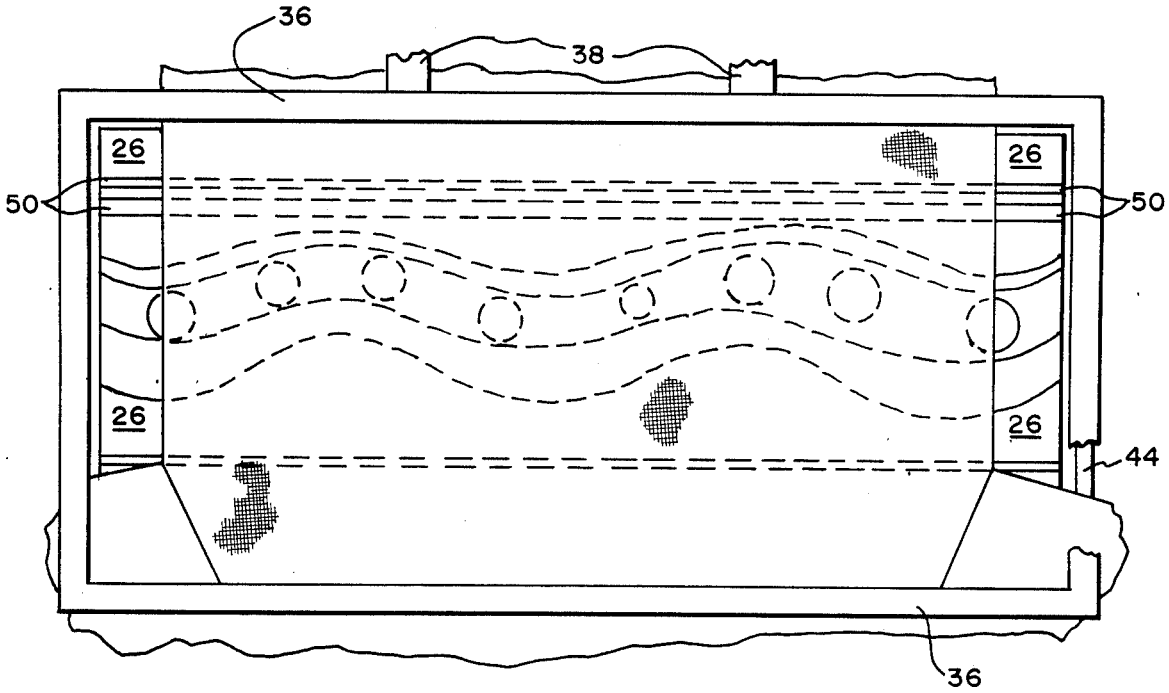

FIG. 4 is a vertical section taken on the line 4—4 of FIG. 2, showing the interaction between the printing platen and the retaining frame of the present invention but showing the retaining frame in slightly raised position; and FIG. 5 is a top plan view of the printing platen assembly of the invention shown holding a tee shirt in position on the platen for printing a "wrap-around" design onto the tee shirt.

DETAILED DESCRIPTION OF THE PREFERRED EMBODIMENT

Figure 1:
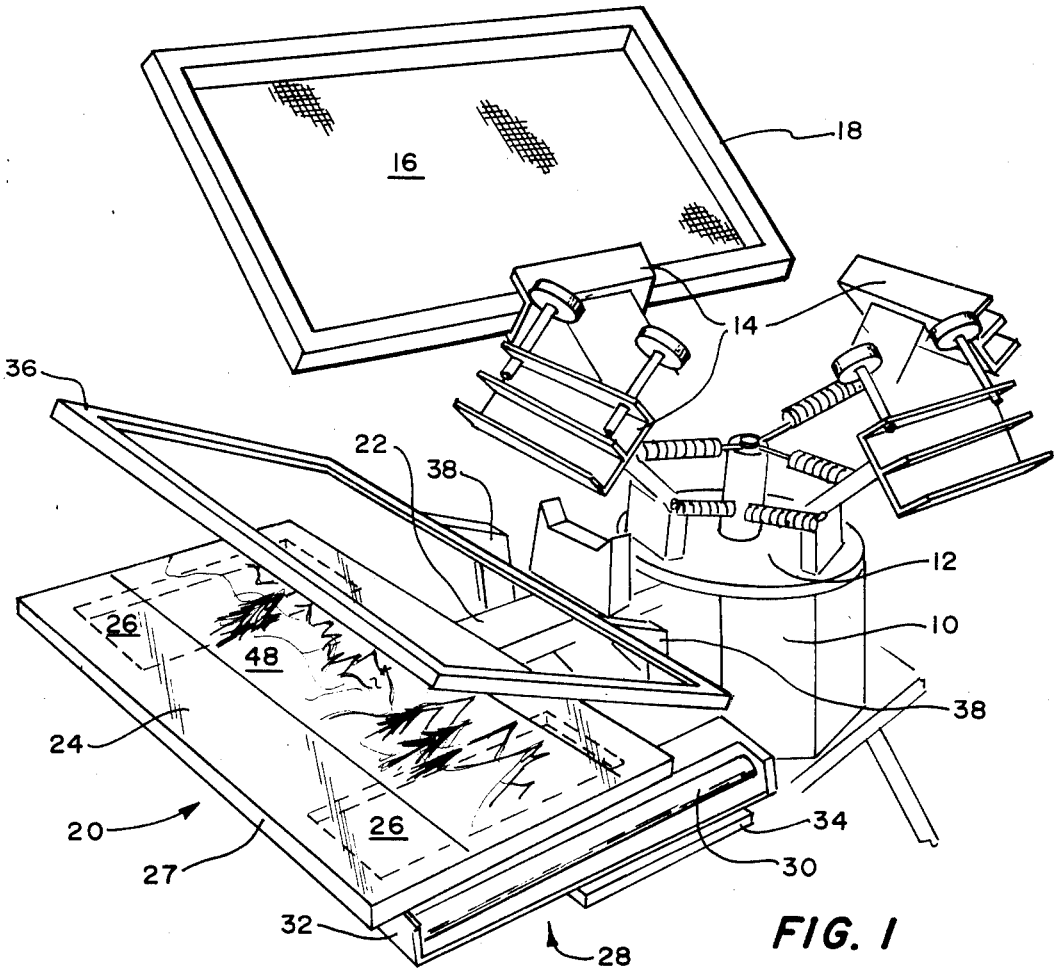
FIG. 1 is a pictorial view of a standard four station screen printing machine showing the printing platen assembly of the present invention installed thereon.

Turning now to the drawings, and initially to FIG. 1, a conventional screen printing machine is partially shown in FIG. 1, to include a frame 10 which supports a rotatable spindle 12. The rotatable spindle includes a plurality of hinged clamps 14 pivotally attached to the rotatable spindle in a customary manner. The hinged clamps 14 are adapted to receive therein and hold in registration a silk screen 16 which is attached to a silk screen frame 18 in the customary fashion.

Screen printing machines of this type include a printing platen connected to the frame 10 thereof in a manner such that the rotatable spindle 12 may be rotated to position the silk screen 16 in a position to be pivoted downwardly to the top of the platen so that the silk screen engages the platen essentially over its entire flat mating surface. In this manner, an operator may use a squeegee or ink roller to press ink through the silk screen material onto an item, such as a garment, positioned on the platen. The above description is of a conventional screen printing machine which may be used for single or multi-color printing and does not constitute part of the instant invention.

The instant invention is directed to an improved platen assembly 20 for screen printing machines, which platen assembly is attached to the screen printing machine frame 10 in a customary manner, as by removably securing the platen assembly 20 through mounting bracket 21 to platen support frame 22 extending for that purpose from frame 10. The platen assembly 20 has an upper smooth flat surface 24. Portions or sections 26 of the platen are constructed of a light transmitting material such as Plexiglass, acrylic, or similar material, formed so as to form light transmitting windows as part of platen 20. In the embodiment of the invention shown, the platen is constructed of a wood base 27 with a top surface of transparent Plexiglass 24 mounted on top of the wood base. The windows 26 are formed by cutting out the wood base material leaving only the Plexiglass material 24. While the construction shown is currently preferred because of strength and cost considerations, the platen could be formed of a single piece of light transmitting material of appropriate thickness to give the required strength and rigity to the platen. The transparent windows 26 are located in the platen in the general areas where the side edges of a tee shirt placed in normal manner on the platen for printing would be positioned so that such shirt edges cross or intersect such windows. Additionally, the windows 26 are preferably of a size sufficient to accommodate a range of sizes of tee shirts. In other words, the windows 26 are sized and located in the platen 20 such that, when any size tee shirt is placed on the platen for printing a pattern on the shirt, both side edges of the shirt will rest on respective windows. When the platen is constructed entirely of transparent or translucent material, the entire flat surface 24 of the platen may be considered as the window.

An illumination device 28 is shown positioned directly under each window 26 in the platen 20. In this particular embodiment, the illumination device 28 takes the form of fluorescent tubes 30 in appropriate receptacles or housings 32. Each fluorescent tube housing is movably supported on a supported bracket 34. The support bracket 34 is supported by a platen substructure 35 secured to the platen base 27 by bracket 35*a*. Support bracket 34 is large enough to permit the fluorescent tube housings 32 to be moved around on the support bracket so that the operator can position the fluorescent tubes 30 directly under any desired portion of platen windows 26.

Figure 3:
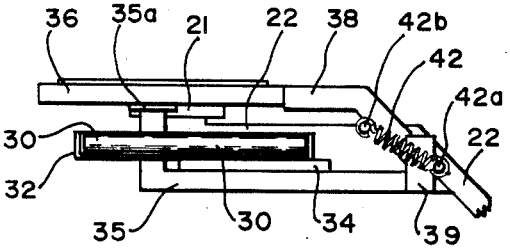
FIG. 3 is a side elevation of the printing platen assembly taken on the line 3—3 of FIG. 2.

Still with reference to FIG. 1, the printing platen of the present invention includes an item retaining frame 36 which is pivotally mounted or hinge mounted to the platen substructure 35, FIG. 3, by frame brackets 38, in a manner such that the frame 36 can be lowered onto the platen 20 to hold an item to be printed in place upon the platen. With reference to FIGS. 3 and 4, the frame brackets 38 are pivotally mounted to hinge brackets 39 by pivot bolt 40. Hinge brackets 39 are secured to the platen substructure 35 in any suitable manner such as by bolts. As best shown in FIG. 3, a spring 42 is attached between pin 42*a*, which is secured, such as by welding, to the platen substructure 35, and pin 42*b*, which is secured, such as by welding, to retaining frame bracket 38 in a manner that results in an over-center mechanism which biases the retaining frame in either its downward position against the platen 20, as shown in FIG. 3, or its upward position, as shown in FIG. 1.

With reference now to FIG. 4, the printing platen 20, illumination device 28 and retaining frame 36 are shown in relative position in vertical section. The retaining frame 36 is shown slightly above the platen, for clarity. As best shown in the detail to FIG. 4, the printing platen 20 includes a slip-resistant material 44 positioned about the peripheral edge of the platen. The inventor has found that a rubber-coated fabric material or a naugahyde material serves very well as this slip-resistant material 44 to retain a garment in position on the printing platen during the screen printing process. Additionally, a foam rubber or sponge material 46 is preferably positioned under the slip-resistant material to cooperate with the retaining frame 36 to retain a garment in position on the platen. With a tee shirt positioned on the platen, as shown in FIG. 5, the lower part of the shirt is permitted to drape over the rear edge of the platen (the upper edge as shown in FIG. 5), while the upper part of the shirt drapes over the front of the platen (the bottom edge as shown in FIG. 5). The tee shirt sleeves, except for small sizes of shirts, may drape over the side edges; the front edge, or both, as shown in FIG. 5.

When the retaining frame is lowered, it fits tightly against the peripheral edge of the platen causing some compression of the foam rubber material 46. The overhanging shirt material is sandwiched between the slip-resistant material and the retaining ring to hold the garment in essentially immovable position therebetween. In this manner, a multi-colored pattern may be screen printed onto the tee shirt using multiple silk screens without fear of the tee shirt slipping on the platen each time a silk screen is raised from its position against the shirt. While the shirt or other item to be printed is held in substantially immovable position by the retaining frame for printing purposes, the shirt may still be moved slightly by the operator for final alignment adjustments prior to printing.

Those skilled in the art will readily appreciate that the positioning frame 36 will always be in accurate fitting relationship with the printing platen 20, because it is secured directly to the platen through substructure 35. Additionally, the illumination device 28, being also mounted on substructure 35, is always in proper position to provide backlighting through the transparent plexiglass windows 26, regardless of the position of the platen relative to the screen printing machine frame 10 and spindle 12. In this manner, the platen, substructure, positioning frame and illumination device, as an integral unit, may be easily attached to and removed from most conventional screen printing machines. When the platen assembly is attached to a screen printing machine, the machine holds the platen assembly in fixed relationship to the silk screens held in the normal silk screen frames because once the frames are secured to the machine, their position relative to the platen assembly, also secured to the machine, is fixed. This is true even though a silk screen may be rotated in relation to the platen assembly so that different screens may be moved into position above the platen asembly. Thus, the platen assembly's securement to the machine provides a means for positioning a silk screen in predetermined relationship to the platen.

OPERATION

The printing platen of the present invention is particularly adapted to print both sides (both front and back) of a tee shirt or similar garment with a "wrap-around" type design, i.e. a design that is continuous all the way around the tee shirt. This is accomplished by printing the front of the shirt with a pattern and the back of the shirt with a mating pattern, which generally will be the same pattern, the patterns (front and back) being in alignment and registered together at the two end edges thereof, generally along the sides of the shirt, under the sleeves. This "wrap-around" design is printed on a tee shirt by using the following sequence of steps. Initially, the pattern is printed across the front (or back) of a tee shirt in the conventional manner. Specifically, the tee shirt is positioned upon the printing platen, the silk screen is lowered into place on top of the tee shirt, the ink is transferred onto the shirt using a roller or squeegee; the silk screen is removed from the tee shirt; if a multi-color design is being printed, the various other colors are similarly printed; and the tee shirt is removed from the platen. It should be noted that, at this intial stage, although the platen of the invention will generally be used, a conventional single color or multi-color platen may be used. Usually, a number of shirts will be printed with the first pattern on one side thereof and then dried prior to printing the second pattern on the other side thereof.

To print the pattern on the back of the shirt, the initial preferred step is to print the pattern directly on the upper smooth flat surface 24 of the printing platen 20, or, at least those portions of the pattern that will fall on the transparent windows 26 will be printed directly onto the windows. It has been found that following a short drying time for the printed pattern on the platen, covering the pattern on the platen with a transparent or translucent tape 48 will preserve the quality of the pattern through multiple shirt printing operations.

The operator is now ready to print the pattern onto the back sides of the tee shirts. The initial step in printing the pattern on the back side of the shirt is to position the shirt on the printing platen in the approximate proper location. The fluorescent tubes 30 supply sufficient backlighting through the light transmitting windows of the platen to enable the operator to clearly see both the pattern printed on the platen and the pattern printed on the tee shirt. It should be noted, however, that the front and back patterns, although the same, are "reversed", in that the tee shirt has been flipped, with the first-printed, front pattern now down against the platen.

As a general rule, tee shirts and the like are sufficiently thin that the backlighting supplied by the fluorescent tube will permit the operator to see the pattern on the front of the shirt sufficiently to enable him to align or otherwise register the back pattern to the front pattern. Of course, the intensity of the florescent tube may be adjusted to compensate for variations in thicknesses of tee shirt material, colors of tee shirt material, etc. The inventor has determined that the addition of a solid bar or set of bars, as shown at 50 in FIG. 5, greatly increases the accuracy of registration of the front to back patterns. These registration bars 50 can easily be incorporated into, and become a part of the pattern itself.

Using the backlighting supplied by the fluorescent tube and passing through the transparent windows to illuminate the patterns on the platen and on the front of the tee shirt, the operator aligns each edge of the pattern at respective edges of the tee shirt with the pattern printed on the platen. With the tee shirt flat on the platen and both edges of the front pattern in alignment with the pattern printed on the platen, the operator now lowers the retaining frame 36 onto the platen to hold the tee shirt in position. As aforestated, the retaining frame cooperates with the slip-resistant material and foam rubber material to sandwich the tee shirt therebetween along the edges of the platen where the tee shirt is permitted to hang over the platen. The spring 42 connected to the positioning frame bracket 38 operates to hold the positioning frame down tightly against the tee shirt and against the printing platen to insure that the tee shirt will remain immobile as the pattern is printed on the back side of the shirt.

Generally, the same pattern is printed on the front and back of a tee shirt. Occasionally, however, it is desirable to print completely different patterns on the front and back, while still maintaining registration between front and back. Also, it is occasionally desirable to print patterns on the shirt front and back that have no registration bars. In instances such as these, the following procedure is used.

The front pattern is printed on the fronts of a number of shirts in the customary manner. To ensure perfect registration of front and back patterns, a "reverse" or mirror image of the front pattern is printed directly onto the printing platen, allowed to dry, and covered with the protective tape 48. The pattern is "reversed" because, in order to print the back pattern, the tee shirt will be flipped on the platen, as aforestated, with the front pattern down against the platen.

Next, the back pattern silk screen and frame are fitted into the printing machine hinged clamp 14 and brought down into position against the platen. The backlighting provided by the illumination device and the printing platen of the present invention permit the operator to see both patterns and register the silk screen with the "reversed" pattern printed on the platen. With the silk screen so registered and the silk screen frame tightened in the hinged clamp, the operator is ready to print the backsides of the tee shirts, as described above, by using the backlighting to illuminate and silhouette the patterns on the platen and the front of the shirt. Because the pattern on the platen is "reversed" and the shirt front pattern is "reversed", the silhouettes of the patterns are identical. Therefore, registering the back pattern to the front pattern is greatly simplified.

The process of fitting the retaining frame onto the tee shirt and the platen occasionally causes the tee shirt to slip slightly from its original registration of the front and back patterns. Therefore, it is occasionally necessary to adjust slightly the position or location of the tee shirt upon the platen simply by pulling on appropriate portions of the tee shirt that are hanging from the platen. In this regard, the foam rubber or sponge material 46 is of a thickness and durometer (hardness) to permit slight adjustment of the tee shirt on the platen by pulling on the free ends of the tee shirt under the retaining frame.

With the tee shirt so positioned on the printing platen, the pattern is printed on the backside of the tee shirt in the customary manner by lowering the silk screen down against the tee shirt and transferring the ink to the shirt with a roller or squeegee. Using this procedure, it would seem that the wrap-around design thus printed on a tee shirt will not be completely wrapped, in that a seam or void in the pattern will be left along the edge of the fold of the tee shirt material on each side of the shirt where the front and back patterns are joined together. It has been found, however, that such a void is usually non-existant, or at least, is unnoticeably small because as the roller or squeegee applies ink to the shirt, ink is also forced through the silkscreen along the edge of the tee shirt, which results in ink being transfered to the platen in the area immediately outside the edge of the shirt. The result is the virtual elimination of a seam or void spot between the front and back patterns. It is a simple matter to clean excess ink from the transparent tape 48 on the platen prior to positioning the next tee shirt for printing upon the platen.

If multi-colored patterns are printed on the tee shirt, the additional silk screens are rotated around and positioned for printing the additional colors on the tee shirt in the customary manner prior to removal of the shirt from the platen. In printing multi-colored designs by using the printing platen of the invention, the retaining frame 36 holds the tee shirt in position upon the printing platen with sufficient accuracy that subsequent colors are transferred onto the tee shirt with the required accuracy of registration.

Following the printing of the design on the back of the tee shirt the retaining frame 36 is raised and the tee shirt is removed from the printing platen and dried in the customary manner.

Those skilled in the art will readily appreciate that, when printing "wrap around" type designs on tee shirts and the like by using a flat silk screen and flat printing platen, it is extremely critical that registration of the front section of the design with the rear section of the design be as close as possible. Additionally, it is imperative that this alignment and registration of the front and rear patterns be accomplished as expediantly as possible. With this in mind, the present invention permits the screen printing machine operator to precisely register the front and back patterns on a tee shirt or the like in a minimum amount of time, thereby providing a substantial savings in labor costs. The operator accomplishes this by comparing and registering the front and back patterns in exact alignment. This is possible because the backlighting provided by the fluorescent lamps shining through the platen windows also shows through the tee shirt material sufficiently to silhouette the two patterns to enable substantially perfect registration.

While specific reference has been made to tee shirts, such reference is intended to include various types of similar shirts such as sweatshirts. Also, while the platen assembly has been specifically described as being used in conjunction with a screen printing machine, the platen assembly and method described may be used with various types of screen printing machines or may be used alone, and in such instance, the silk screens in the normal screen frames would be placed manually on the platen assembly. When placed on the platen assembly, the silk screen is aligned and positioned with respect to the platen by means of shape or by means of other positioning indicia such as mating pins so that each time the silk screen is placed on the platen, it is positioned in the same predetermined relationship to the platen and the item thereon to be printed.

Whereas this invention is here illustrated and described with specific reference to an embodiment thereof presently contemplated as the best mode of carrying out the invention in actual practice, it is to be understood that various changes may be made in adapting the invention to different embodiments without departing from the broader inventive concepts disclosed herein and comprehended by the claims that follow.

I claim:

1. A method of aligning and printing meeting designs on items to be printed, comprising the steps of printing the first design on the item to be printed wherein said printed design extends to an edge of the item where it is to meet with a second design to be printed; placing the item on a printing platen with the first design against the platen and the edge of the item where the second design is to meet the first design positioned over a light transmitting portion of the platen; allowing light to be transmitted through the light transmitting portion of the platen to thereby show the position of the first design at the edge of the item where the designs are to meet; positioning the item on the platen so that the second design to be printed will properly meet the first design at the edge of the item; and printing the second design on the item.

2. A method of aligning and printing meeting designs on items to be printed in accordance with claim 1, wherein the additional step is included of printing an aligning guide on the light transmitting portion of the platen at least over the area intersecting the normal position of the edge where the designs are to meet when the item is placed on the platen; and wherein the step of positioning the item on the platen so that the designs will properly meet includes positioning the first design with respect to the aligning guide printed on the platen.

3. A method of aligning and printing meeting designs on items to be printed in accordance with claim 2, wherein the aligning guide printed on the platen is the second design.

4. A method of aligning and printing meeting designs on items to be printed in accordance with claim 2, wherein the aligning guide printed on the platen is a mirror image of the first design.

5. A platen assembly for use in screen printing wrap around designs on tee shirts and the like, wherein designs are to be printed on the front and back of the shirts with the designs meeting at the edges of the shirts below the sleeves, and wherein the platen assembly allows easy alignment of the designs at the edges of the shirt, comprising a printing platen adapted to receive thereon the shirt to be printed and the edges of the shirt where the designs are to meet and having at least the portions thereof which intersect the edges where the designs are to meet when the shirt to be printed is in normal printing position on the platen adapted to transmit light therethrough; illumination means positioned to direct light through the light transmitting portions of the platen which intersect the edges of the shirt; retaining means for holding the shirt to be printed in predetermined position on the platen; and means for positioning a silk screen in fixed relationship to said platen.

6. A platen assembly according to claim 5, wherein the light transmitting portions of the platen are a pair of windows arranged so that respective windows underlie respective edges of the shirt where the designs are to meet.

7. A platen assembly according to claim 5, wherein alignment means are additionally included on the portions of the platen intersecting the edges where the designs are to meet.

8. A platen assembly according to claim 7, wherein the alignment means are at least portions of the design to be printed on the shirt and are included on the platen by being printed on the platen.

9. A platen assembly according to claim 5, wherein the platen has a periphery and is of a size so that the shirt to be printed hangs over at least portions of two sides of the platen, and wherein the shirt retaining means is adapted to engage at least portions of the periphery of the platen with the shirt hanging thereover to thereby engage and hold the shirt.

10. A platen assembly according to claim 9, wherein the shirt retaining means includes a closed loop frame adapted to engage the platen periphery.

11. A platen assembly according to claim 5, wherein the means for positioning a silk screen in predetermined relationship to the platen is means for mounting the platen assembly on a screen printing machine.

12. A platen assembly for use in screen printing which allows easy alignment of items for multi-step printing of designs wherein the designs in at least two of the steps are arranged end-to-end and meet at at least one edge of the item to be printed, comprising a printing platen adapted to receive thereon the items to be printed and the at least one edge of such items where the designs are to meet and having at least the portion thereof which intersects the at least one edge where designs are to meet of the item to be printed when in normal position on the platen adapted to transmit light therethrough; item retaining means for holding the item to be printed in predetermined position on the platen; and means for positioning a silk screen in fixed relationship to said platen.

13. A platen assembly according to claim 12, additionally including illumination means positioned to direct light through the light transmitting portions of the platen.

14. A platen assembly according to claim 13, wherein the items to be printed are tee shirts or the like, wherein designs are to be printed on the front and back of the shirts with the designs meeting at the edges of the shirts below the sleeves, and wherein the light transmitting portions of the platen are a pair of windows arranged so that respective windows respective edges of the shirt where the designs are to meet.

15. A platen assembly according to claim 14, wherein the platen has a periphery and is of a size so that the shirt to be printed hangs over at least portions of two sides of the platen, and wherein the item retaining means is adapted to engage at least portions of the periphery of the platen with the shirt hanging thereover to thereby engage and hold the shirt.

16. A platen assembly according to claim 15, wherein the item retaining means includes a closed loop frame adapted to engage the platen periphery.

17. A platen assembly according to claim 16, wherein the periphery of the platen has a slip-resistant material thereon.

18. A platen assembly according to claim 17, wherein the slip-resistant material is resiliently mounted.

19. A platen assembly according to claim 17, wherein the slip-resistant material is also resilient.

20. A platen assembly according to claim 16, wherein the means for positioning a silk screen in predetermined relationship to the platen is means for mounting the platen assembly on a screen printing machine.

21. A platen assembly according to claim 12, wherein the platen has a periphery and is of a size so that the item to be printed hangs over at least portions of two sides of the platen, and wherein the item retaining means is adapted to engage at least portions of the periphery of the platen with the item hanging thereover to thereby engage and hold the item.

22. A platen assembly according to claim 12, wherein the means for positioning a silk screen in predetermined relationship to the platen is means for mounting the platen assembly on a screen printing machine.

* * * * *